United States Patent [19]

Hart et al.

[11] Patent Number: 5,031,543

[45] Date of Patent: Jul. 16, 1991

[54] SIDE PANEL ANTI-ABRASION ENVELOPE

[75] Inventors: James D. Hart, Grove City; Russell L. Long, Greenville, both of Pa.

[73] Assignee: Trinity Industries, Inc., Dallas, Tex.

[21] Appl. No.: 568,743

[22] Filed: Aug. 17, 1990

Related U.S. Application Data

[63] Continuation of Ser. No. 369,764, Jun. 22, 1989, Pat. No. 4,964,347.

[51] Int. Cl.[5] ..... B61D 17/08

[52] U.S. Cl. ..... 105/355; 105/404; 105/378

[58] Field of Search ..... 105/355, 378, 404, 408, 105/410, 423, 424; 160/381; 52/243, 243.1; 211/184; 410/129

[56] References Cited

U.S. PATENT DOCUMENTS

| | | | |
|---|---|---|---|
| 953,758 | 4/1910 | Payntar | 160/381 |
| 1,017,958 | 2/1912 | Cole | 160/381 |
| 1,632,022 | 6/1927 | Cook | 160/381 |
| 1,779,859 | 10/1930 | Shrauger | 160/381 |
| 2,768,410 | 10/1956 | Woodard | 160/381 |
| 4,059,056 | 11/1977 | Berryman et al. | 105/423 |

FOREIGN PATENT DOCUMENTS

| | | | |
|---|---|---|---|
| 0165733 | 10/1955 | Australia | 160/381 |

*Primary Examiner*—Douglas C. Butler
*Assistant Examiner*—Mark T. Le
*Attorney, Agent, or Firm*—Myers & Assoc., Ltd.

[57] ABSTRACT

A railway car side panel assembly with upright support posts forming the side walls of the car wherein painted or galvanized panels are protected from rusting by plastic inserts positioned between the corners of the panels and metal brackets on the posts to prevent vibration-abrasion of the galvanizing or paint and of the corners to rust, the plastic inserts being of flexible plastic material and formed as envelopes pocketing the corners and fitting into the complementary brackets, the envelopes each having a side wall with a retainer bottom snapped over flange edges of the panel to hold the envelope from falling off during assembly with the brackets.

6 Claims, 3 Drawing Sheets

FIG. 1
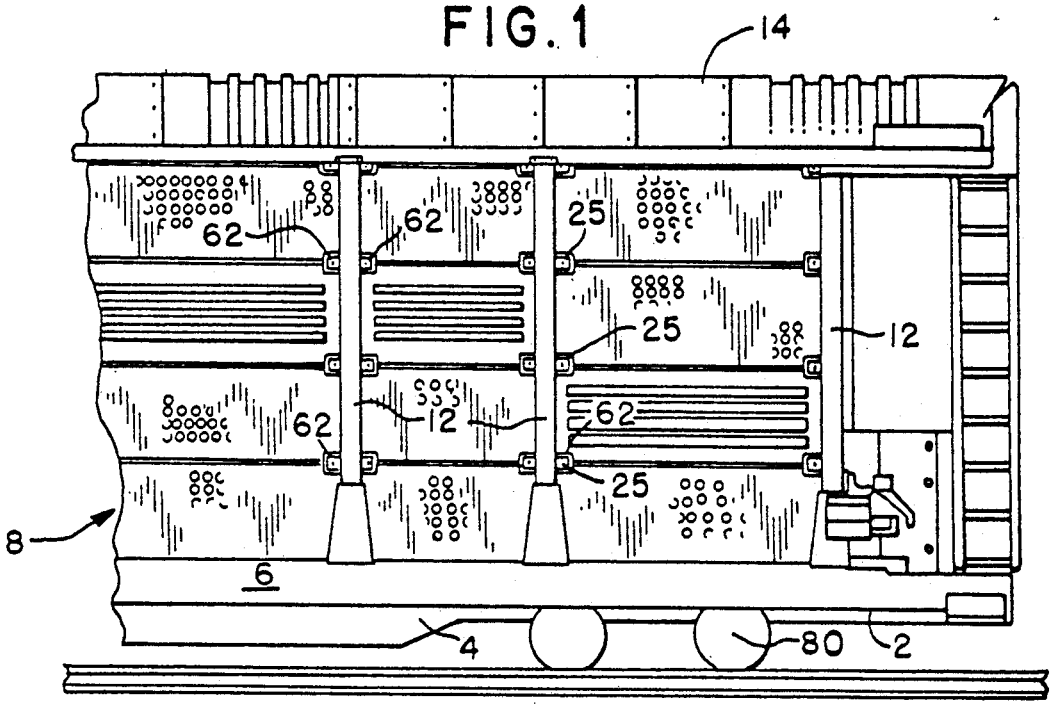
FIG. 2
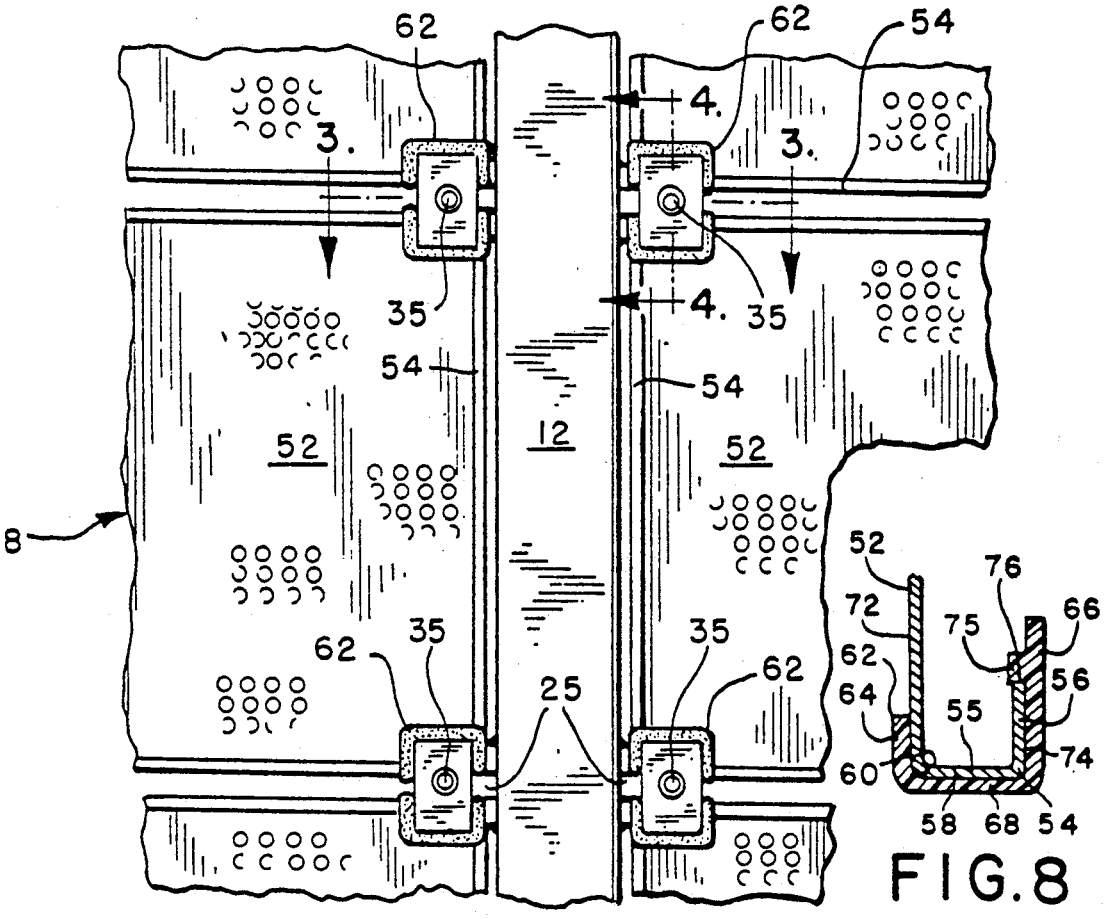
FIG. 8

FIG. 3
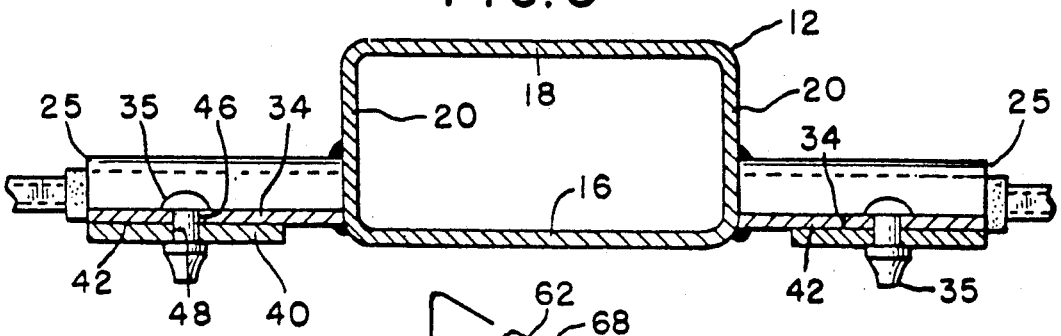
FIG. 4
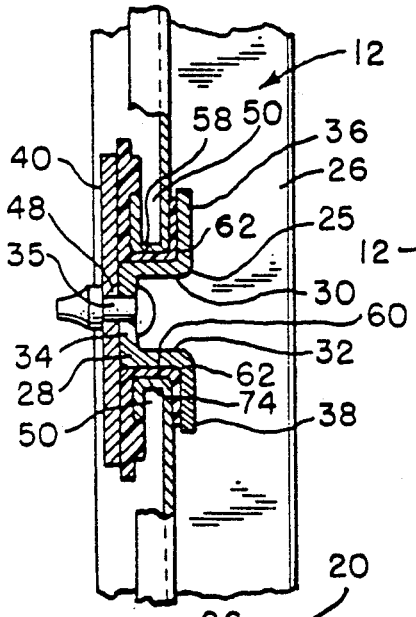
FIG. 5
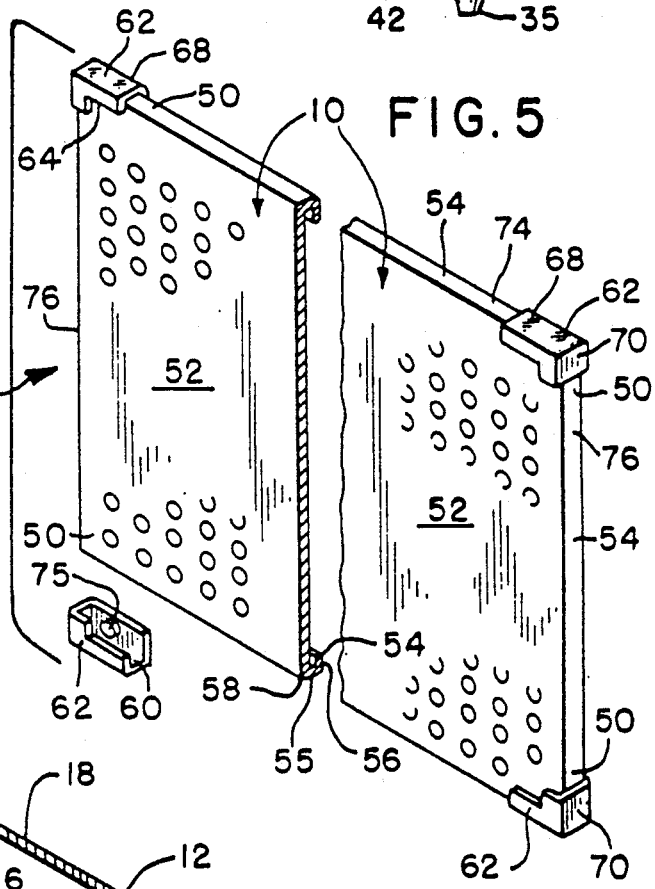
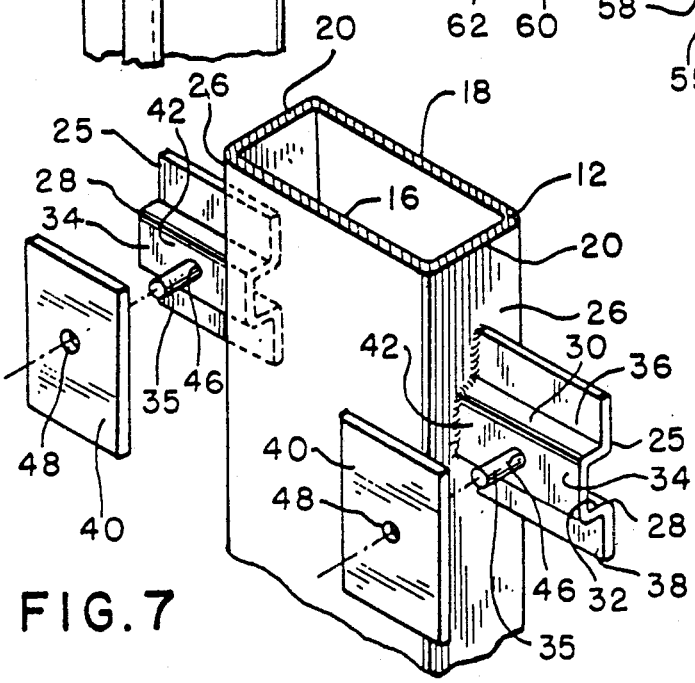
FIG. 7
FIG. 6
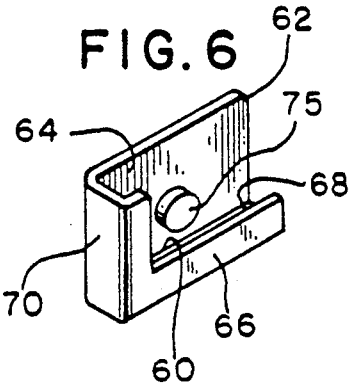

SIDE PANEL ANTI-ABRASION ENVELOPE

This application is a continuation of our U.S. patent application Ser. No. 07/369,764 filed Jun. 22, 1989 now U.S. Pat. No. 4,964,347 issued Oct. 23, 1990.

BACKGROUND OF THE INVENTION

This invention appertains to auto rack railway cars which comprises perforated reflective side panels forming the side walls of a car.

The perforated and reflective characteristics of the interior faces of these panels are important in that they increase the visibility inside the car and to thus facilitate loading and unloading of automobiles and trucks with respect to the interior of the car.

One of the serious problems is the discoloration of the panels by rust. A major source of rust discoloration on auto racks can be attributed to the destruction of the interface of the galvanized or painted side panels and the side panel retainers. This interface is subjected to constant movement between the side panels and the retainers due to the flexibility of the rack structure and vibration of the rail car. This movement results in the paint deteriorating on the column brackets producing rust generation points. At the same time the panel movement is gradually removing the protective layer of galvanizing from the side panel introducing additional rust generation points.

The discoloration of the side panel is more than an aesthetic problem because it also lowers the light reflecting properties of the interior of the auto rack. This makes the interior of the auto rack dark enough to cause the operating personnel difficulties in the loading/unloading operations and application of the vehicle restraint systems. The resulting safety and damage claims have caused the automobile manufactures to apply a considerable amount of pressure on the railroads to improve the light reflective properties of the interior of auto racks. One result of the pressure is included in the new rack certification program which requires that certified cars be repainted. An additional problem with the rust generated at the interface points is the damage to the finish on new automobiles.

SUMMARY OF THE INVENTION

A broad object is to eliminate the rusting areas by providing a novel plastic insert between the abrading parts of the panel and mounting brackets.

A further object is to provide such insert which can be sleeved onto the corners of the rectangular side panels of the car and fitted within mounting brackets on the vertical posts extending from the bed frame of the car to the roof, the inserts being in the form of corner portions of envelopes of plastic material which envelope the corners of the panels.

These and other objects and advantages of the invention will become more apparent from the specifications and drawings, wherein:

FIG. 1 is a side view of a portion of a railway car incorporating the invention;

FIG. 2 is an enlarged portion of the side panels of a car and mountings therefor;

FIG. 3 is a enlarged horizontal cross-section taken on line 3—3 of FIG. 2;

FIG. 4 is a vertical cross-section taken substantially on line 4—4 of FIG. 2;

FIG. 5 is a broken apart perspective view of a side panel with the corner protectors applied thereto;

FIG. 6 is a perspective view of the corner protector; and

FIG. 7 is an exploded view of the support bracket and mounting post assembly;

FIG. 8 is an enlarged cross-section of a portion of the section shown in FIG. 4.

DESCRIPTION OF THE FIGS. 1-8

Figure 9:
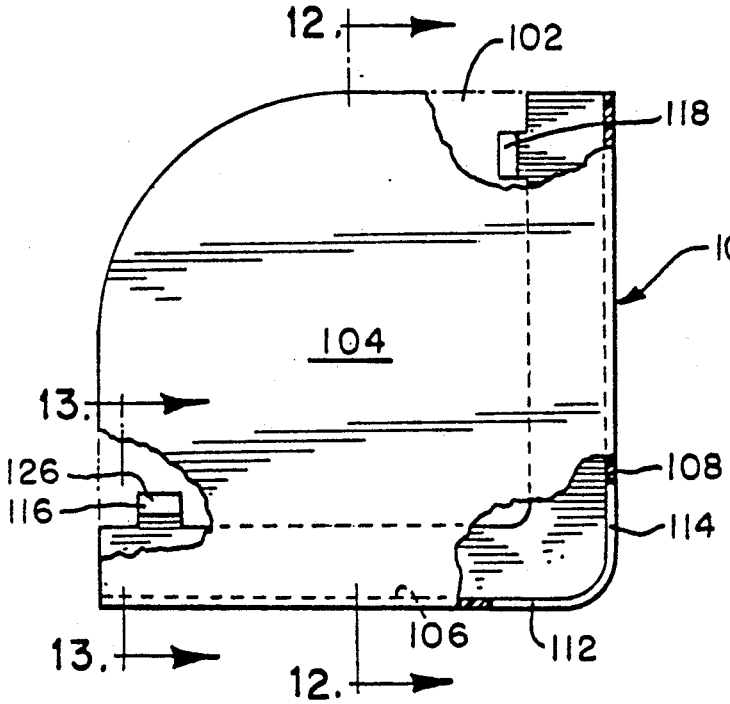
FIG. 9 is a side elevation of a second embodiment of the invention.
Figure 10:
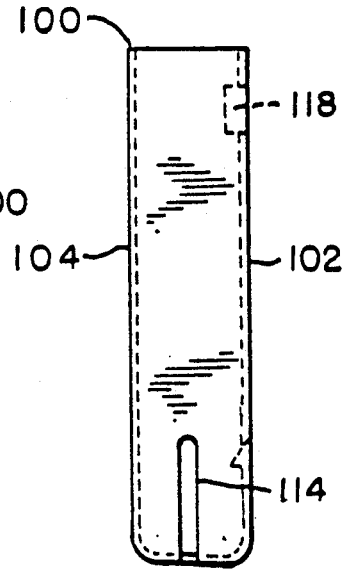
FIG. 10 is an edge view.
Figure 11:
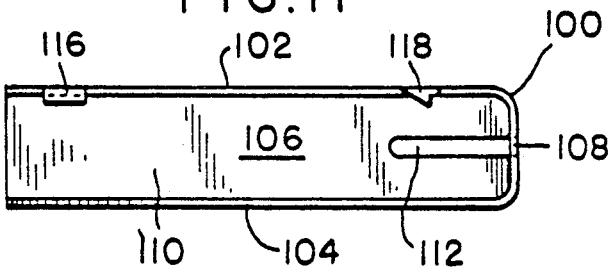
FIG. 11 is a top view.
Figure 12:
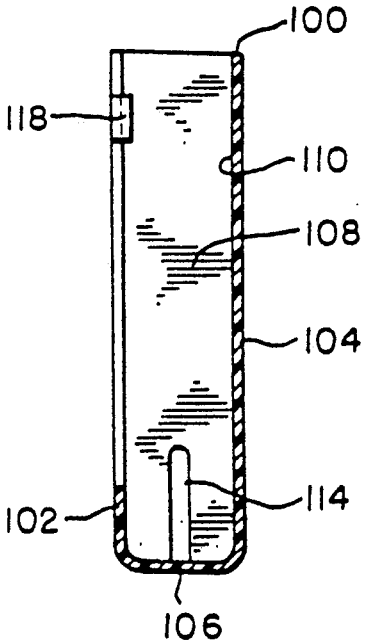
FIG. 12 is a cross-section taken on line 12—12 of FIG. 9.

FIG. 1 illustrates a rail car having a bed frame 2 including a center sill 4 and a side sill 6 at each side and side walls 8 comprising a plurality of perforated rectangular panels 10 positioned between upright vertical post 12 which extend from the side sills to roof 14 and are connected therewith in conventional manner.

Each post 12 is a tubular member having inner and outer vertical walls 16, 18 and fore and aft interconnecting lateral side webs 20, 20.

A plurality of hat shaped mounting brackets 25, 25 are welded along one edge to opposite sides 26, 26 of the column 12 and project lengthwise of the car. Each bracket has a U-shaped intermediate portion 28 with top and bottom horizontal webs 30, 32 and a vertical web 34 interconnecting the webs 30, 32. The free edges of the webs 30, 32 are provided with integral upright flanges 36, 38, flange 38 depending from web 32 and flange 36 upstanding from web 30.

A securing plate 40 is positioned against the exterior side 42 of each web 34 and is secured thereto by a mechanical fastener such as a rivet 35 passing through openings 46, 48 in web 34 and plate 40. The securing plates are connected to respective brackets 24 after the wall panels 10 are mounted within the brackets 25 as seen in the drawings.

As best seen in FIGS. 4–6, each panel is of a rectangular shape and has corners 50. The panel has a center perforated or louvered flat plate portion 52 through which light passes into the interior of the car. The center section is formed on its inner side about its periphery with a reinforcing flange 54 having a transverse portion 55 and an inturned flange portion 56 (FIG. 8) forming a wide edge 58 for mounting and reinforcing the panel.

The wide edge 58 is entered at the corners within a complementary pocket 60 of a plastic protector 62 which is U-shaped in cross section and has inner and outer walls 64,66 and transverse interconnecting horizontal and vertical webs 68, 70. The wall 64 seats against the outer side 72 of the panel and the web 66 seats against the external flange 74 of the perimetric flange 54. The vertical web 70 seats against vertical edge 76 of the flange 54 and web 68 seats against the horizontal edge 74 of the flange 54.

The wall 66 is provided with a deformable nib or protrusion 75 which snaps over the edge 76 (FIG. 8) of the flange portion 56 to retain the protector with the panel during installation.

Each protector or jacket fits with its corner within an associated bracket between the securing plate and the respective upright vertical wall 36 or 38 and seats at its vertical and horizontal edges through webs 70, 74 against the respective webs or walls of the associated bracket 25. As each panel is applied and the parts of each bracket are appropriately positioned, they are secured by the respective mechanical fastener such as a rivet 35 within the sockets provided by the brackets.

Thus, as the rail car vibrates and bumps and sways, the panels are held in place through the flexible protectors which are made of suitable materials such as polypropylene or polyethylene or similar resin material. This assembly thus precludes the abrasion previously occasioned and the paint or galvanized cladding is not abraded and does not expose the steel panels to rust corrosion which bleeds onto the inner and outer surfaces of the panels creating the problems heretofore discussed.

The plastic inserts which may be made of self lubricating plastic such as nylon or elastomers to provide tight but flexible mounting which accommodates slight warping. The term plastic includes elastomers materials.

The cars are carried on car trucks 80 in usual manner.

DESCRIPTION OF THE FIGS. 9-13

In this embodiment parts similar to those of the previous embodiment will be identified by the same numerals.

The side panel 10 comprises corners 50 and has a center section 52 formed on its inner side about its periplery with a reinforcing flange 54 having a wide edge transverse section 58 and an inturned flange portion 66 for mounting and reinforcing the panel.

The wide edge 58 is entered at the corners within complementary pockets 100 made of plastic material such as a suitable resin polyethylene of polypropylene and the like.

The pocket or envelope 100 comprises a pair of laterally spaced upright inner and outer side walls 102, 104 and intervening horizontal and vertical transverse webs 106, 108 interconnecting the walls 102, 104 and defining a cavity 110 therewith.

Figure 13:
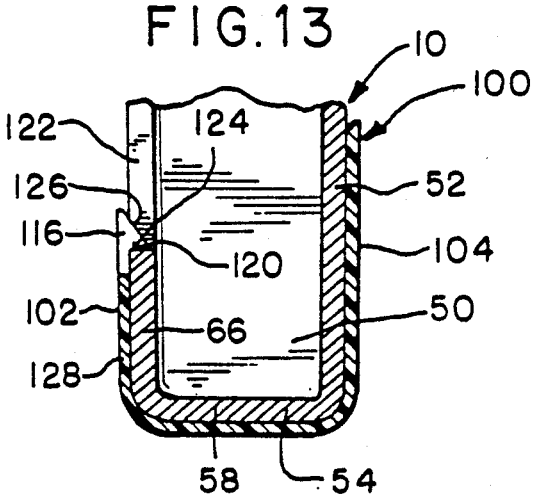
FIG. 13 is a further enlarged cross-section taken on line 13—13 of FIG. 9.

Since the envelope 100 is laterally symmetrical in can be equally applied to the upper or lower opposite end corners of each panel. The corner juncture of the webs 106, 108 of the webs 106, 108 is slotted to provide water drain slots 112, 114 and the inner wall is provided with latching projections 116, 118 which are adapted to snap over the flat edges 120, 122 of the inboard flange of the panel as seen in FIG. 13.

Each projection 116, 118 has a flat inner edge 124 which extends normal to the flange portion 56 for flat face engagement with the edge 120 or 122. The outer face 126 of each locking protuberance 116 and 118 is sloped between the inner face 128 of the inner side wall and the inner end of face 124 at about a forty five degree angle. The face 126 thus easily wedges over the inner face 128 and deflects the inner wall of the envelope as the envelope is forced onto the corner. When the projections 116, 118 pass beyond the inner edges of the 120 or 122 of the flange portions 66, the projections snap over the edges 120 or 122 and position as shown in FIG. 13 to hold the envelope from slipping off during assembly of the panels with the mounting brackets.

Inasmuch as the envelope is flexible and resilient it can be removed by unlatching the projections from the flange and removing the envelope by the side walls thereof deflecting.

We claim:

1. A protective anti-abrasion plastic envelope for mounting on corners of quadrilateral panels forming a side of a railway car, each panel having vertical and horizontal edges and flanking inner and outer sides wherein the inner side comprises an internal flange forming a frame with a peripheral edge, said envelope having inner and outer side portions for embracing said panel, means for interlocking said envelope with the panel comprising inwardly extending latch means on said inner side portion of the envelope adapted in latching position to overlap said peripheral edge of the flange, and wedge means on said latch means adapted to deflect said inner side portion attendant to engagement of the latch means with a portion of the associated corner upon insertion of the corner into the envelope for placing said latch means in engagement with said peripheral edge of the flange.

2. The invention according to claim 1 and said wedge means comprising a sloping wedging surface on said latch means disposed in a position to engage a corner portion of panel.

3. The invention according to claim 2 wherein said latch means comprises a projection formed integral with said inner side portion of the envelope and having a flat side for seating against said edge.

4. A protective corner-covering for a panel of a railway car comprising a flexible plastic corner-piece member having a pair of panel-embracing side portions and an intervening panel edge-covering portion interconnecting said side portions and developing a pocket for admitting a corner of the panel therein, one of said side portions having an integral latching projection with means for wedging the projection against an adjacent side of a panel attendant to insertion of the panel corner into said corner-piece member for consequent engagement with a latch-engaging portion of the panel.

5. The invention according to claim 4 and said projection having a wedge surface engagable with a portion of a panel corner for spreading projection away from the panel corner as the corner-piece is being forced onto the corner of the panel.

6. The invention according to claim 5 and said projection having a surface on a side thereof in position to engage an opposing edge on the panel.

* * * * *